United States Patent [19]

Weiss et al.

[11] 4,368,875

[45] Jan. 18, 1983

[54] FENCE SUPPORT STRUCTURE, ESPECIALLY FOR EQUESTRIAN SHOW JUMPING

[75] Inventors: Juergen Weiss, Rhens; Vinzenz Neisius, Ochtendung, both of Fed. Rep. of Germany

[73] Assignee: Aluteam Sport- und Freizeit GmbH, Mayen, Fed. Rep. of Germany

[21] Appl. No.: 196,153

[22] Filed: Oct. 10, 1980

[30] Foreign Application Priority Data

Mar. 15, 1980 [DE] Fed. Rep. of Germany ... 8007230[U]

[51] Int. Cl.[3] ..... E04H 17/14; A63K 3/04; A63B 5/00

[52] U.S. Cl. ..... 256/59; 256/65; 256/67; 119/29; 272/102; 248/251

[58] Field of Search ..... 256/59, 65, 66, 67, 256/24, 68; 272/101, 102, 103; 119/29; 248/251; 403/328

[56] References Cited

U.S. PATENT DOCUMENTS

| | | | |
|---|---|---|---|
| 358,461 | 3/1887 | Lee | 256/65 |
| 3,362,738 | 1/1968 | Dygert et al. | 403/328 X |
| 3,514,062 | 5/1970 | Gordon | 272/101 X |
| 3,749,344 | 7/1973 | Racina | 272/101 X |
| 4,239,168 | 12/1980 | Colonna des Princes | 119/29 X |

FOREIGN PATENT DOCUMENTS

| | | | |
|---|---|---|---|
| 2048517 | 3/1971 | France | 119/29 |
| 2455471 | 11/1980 | France | 119/29 |
| 7901539 | 8/1979 | Netherlands | 119/29 |

*Primary Examiner*—James Kee Chi

*Attorney, Agent, or Firm*—W. G. Fasse; D. H. Kane

[57] ABSTRACT

A structure for supporting an obstacle, such as a so-called fence for use in equestrian show jumping, includes upright posts, each with a guide rail and a vertical row of holes in the guide rail. One or several obstacle support members are slidably adjustable up and down along the guide rails and arrestable in predetermined positions by a spring biased bolt which may be withdrawn manually from a hole for the adjustment movement. After adjustment the spring bias again urges the bolt into the respective hole.

14 Claims, 7 Drawing Figures

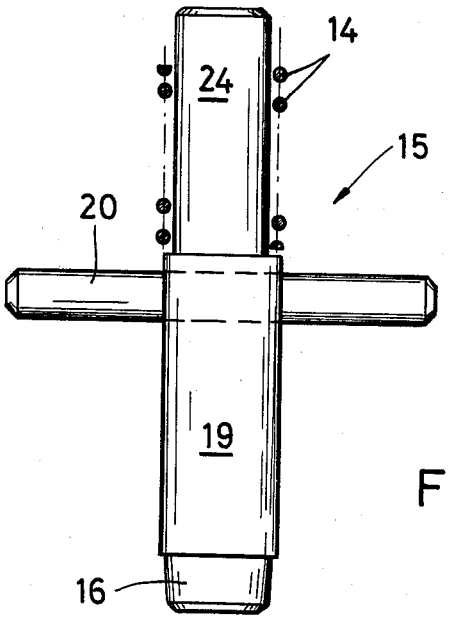
Fig. 4
Fig. 5
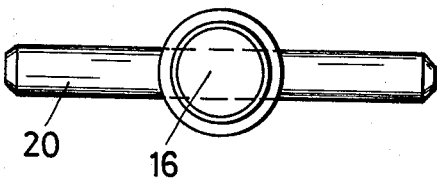

FENCE SUPPORT STRUCTURE, ESPECIALLY FOR EQUESTRIAN SHOW JUMPING

CROSS-REFERENCE TO RELATED APPLICATION

The present application is based on German Utility Model application No. 8,007,230 filed in the Federal Republic of Germany on Mar. 15, 1980. The priority of the German filing date is claimed.

BACKGROUND OF THE INVENTION

The present invention relates to a fence support structure, especially for equestrian show jumping. Such support structures normally comprise two upright posts spaced from each other. Each post is provided with support means of any suitable structure for holding an obstacle such as a so-called fence or the like. The upright posts or frame members may be made of wood or hollow metal sectional components. The support structures include obstacle holding means in the form of half shells. The half shells are adjustable in their elevational position relative to the upright posts.

Fence support structures of the above type are well known in the art. For example, hollow aluminum sectional members are used for the upright posts and the supporting half shells are also made of the same material. Prior art so-called half shells are provided with clamps constructed to completely surround the upright posts in a slanted position. In order to arrest the half shell in a fixed position along the length of the posts, the clamps are provided on the inwardly facing surface with a horizontally arranged bolt which may be inserted in respectively fitting holes of a row of holes arranged in the upright post on the side facing away from the obstacle components. If it is necessary to bring the obstacle into another elevational position, the clamps are moved from their slanted position into the horizontal position, whereby the bolt is withdrawn from the hole and the clamp can be shifted freely along the length of the post.

The above described prior art structure has certain disadvantages because it is suitable only for upright posts, the backside of which is freely accessible. Further, the elevational adjustment is cumbersome because the holes for receiving the holding bolt of the half shell are arranged on the backside of the upright post and are therefore not easily visible for insertion of the holding bolt.

Another disadvantage of the prior art structure is seen in that the clamps as well as the upright posts must be made of metal because the clamps are not suitable for insertion in wooden posts. Additionally, the clamps must be so dimensioned as to provide a substantial play to permit any adjustment at all. This large size of the clamps or brackets has the further disadvantage that even small impacts on the structure, for example, during jumping, cause a clattering noise which frequently disturbs the horses. Besides, the supporting shells are not securely fixed in position so that they become loose or displaced when the fence is toppled over by a jumping horse. Thus, the clamps or brackets slide downwardly and it is necessary to reset them in the proper position which is cumbersome and time consuming.

Moreover, it is disadvantageous that the half shells on which the ends of the fence rails or the like rest, are made of metal because such metal half shells have sharp edges which could cause injuries.

Yet another disadvantage of the prior art structure is seen in that it is not suitable for use in connection with all types of supports. For example, the prior art structure cannot be used in connection with a solid wooden upright post, nor can it be used as a so-called catch post. The prior art structure is also not suitable for use in connection with tower structures or walls of wood between which the obstacles are arranged.

OBJECTS OF THE INVENTION

In view of the above it is the aim of the invention to achieve the following objects singly or in combination:

to provide a fence support structure which makes it possible to precisely adjust the elevational position of the supporting members without effort regardless of the type of upright post that is employed for supporting the obstacle rails or the like;

to construct the support structure in such a manner that the adjustment mechanism is safe in its function and robust in its structure;

to make sure that the entire support structure will not rattle in response to shocks or vibrations;

to construct the support structure in such a manner that it may be assembled to wooden upright posts even if the latter have been used before; and to make sure that the obstacle holding means or support members are automatically arrested under all operating conditions and independent of a slanting position of the support member or bracket relative to the upright post.

SUMMARY OF THE INVENTION

According to the invention each upright post is equipped on its side facing the obstacle, such as rails or the like, with a continuous, rail type sectional component which forms a sectional first guide means. An obstacle holding means or several of such obstacle holding means including support shells for the rails or fence components are guided by second guide means along the rail type first guide means for up and down movement along the first guide means in a manner so that the holding means cannot be removed from the post except in the longitudinal direction. In other words, the holding means are normally undetachable in the horizontal direction and can be detached only intentionally by an operator in the vertical direction of the upright post. The rail type first guide means preferably has a symmetrical shape relative to a central longitudinal axis and is equipped with a row of holes for receiving an arresting bolt. The arresting bolt is held in a housing and movable in the direction toward the row of holes under the force of a biasing spring, whereby the respective obstacle holding means may be locked in any desired elevation as determined by the position of the respective hole along the first guide means.

Preferably, the first guide means may be an open sided sectional component or member made of light metal, preferably aluminum which is provided with lateral flanges having holes therein for securing the guide rail to the supporting upright post, for example, by means of screws or the like.

The housing, the top of which forms the support or half shell for the obstacle such as a rail or the like, has a recess in its underside. The arresting bolt and the biasing spring are received in the recess. Due to the arrangement of the row of holes on the side facing toward the obstacle it is possible to attach the present structure to any kind of support, such as an old upright wooden post because the guide rail can merely be screwed to the post.

Another advantage is seen in that the entire holding structure including the half shell support element and the arresting bolt can be removed from the guide rail only in an axial direction, but not in a lateral direction. Due to the secure guiding of the entire obstacle holding means including the arresting bolt along the guide rail a clattering noise is substantially avoided when the structure is subject to shocks or vibrations. Even if the whole obstacle assembly topples over, it is not possible that the holding means can shift themselves up and down the rail and it is also prevented that the holding means fall off the rail. The spring biased arresting bolt makes sure that the holding means automatically arrest themselves as soon as the bolt engages into any one of the holes.

By placing the arresting means on the same side as the obstacle holding means, the handling of the structure is facilitated and the elevational adjustment is simpler without any need for searching for an arresting bore on the opposite side of the upright post. Another advantage of the invention is seen in that a more precise guiding is now possible because the obstacle holding means can now be dimensioned exclusively with regard to the dimension of the guide rail and not with regard to permitting a tilting movement of the entire bracket for an elevational adjustment as was necessary in the prior art.

As mentioned, the guide rail may be a separate component or it may be an integral component of the upright post which thus may be a hollow profile or sectional member of light metal, preferably aluminum, while the support or obstacle holding elements proper can be made of rugged, wear and load resistant synthetic material with smooth edges. Thus, it is possible to substantially reduce the weight of the present structures, as compared to prior art structures, thereby facilitating the handling of the present structures. Further, making the obstacle holding or support means of synthetic material further reduces any clattering noise caused heretofore by shocks or vibrations. The danger of injuries is also substantially excluded.

BRIEF FIGURE DESCRIPTION

In order that the invention may be clearly understood, it will now be described, by way of example, with reference to the accompanying drawings, wherein:

FIG. 4 is a top plan view of the arresting bolt, whereby the biasing spring is shown only in a symbolical manner;

FIG. 5 is a front view in the axial direction of the arresting bolt against the arresting end of the bolt;

DETAILED DESCRIPTION OF PREFERRED EXAMPLE EMBODIMENTS AND OF THE BEST MODE OF THE INVENTION

Figure 1:
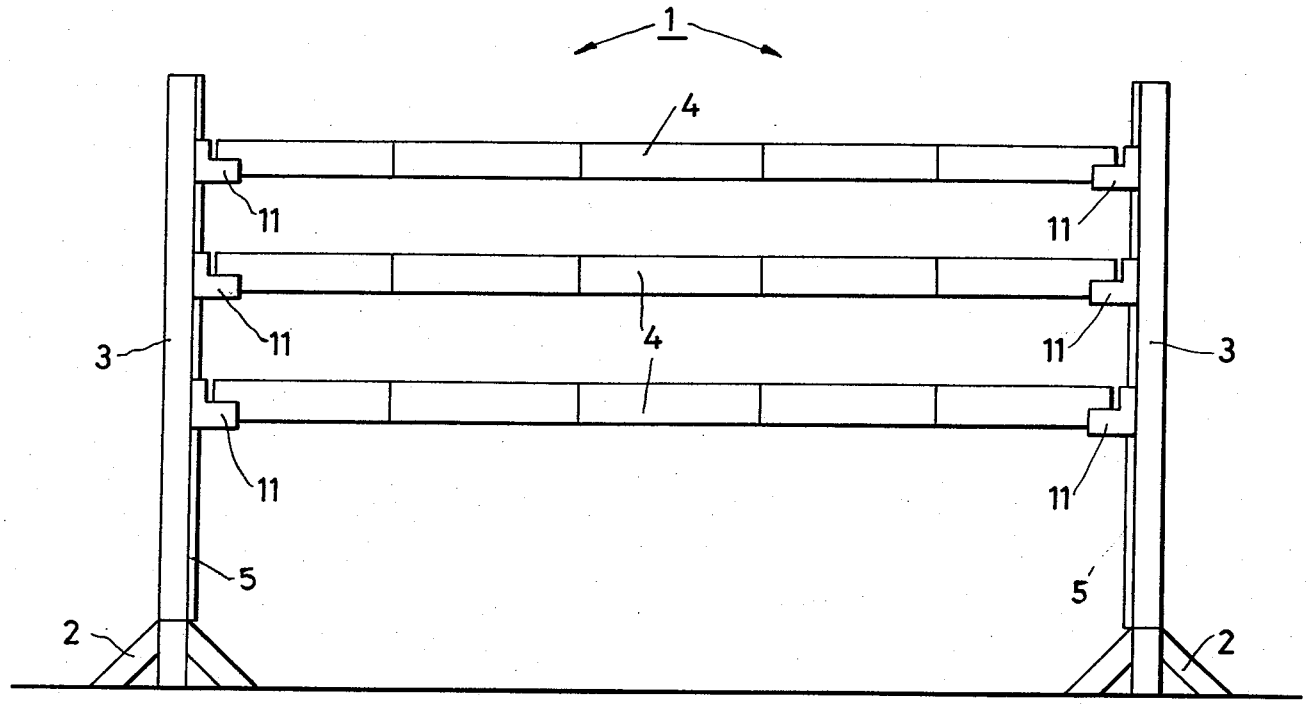
FIG. 1 shows a front elevational view of a fence support structure, especially for equestrian show jumping, with two upright posts of hollow aluminum sectional stock, whereby each post is equipped with three obstacle holding elements for supporting three horizontal rails.

FIG. 1 shows a front view of a fence structure 1 for equestrian show jumping events. The fence 1 comprises two upright posts 3 with footings 2 of conventional construction. The posts 3 may, for example, be light metal, hollow sectional stock provided with guide rails 5 to which there are adjustably secured obstacle support or holding means 11 to support horizontal rails 4.

Figure 2:
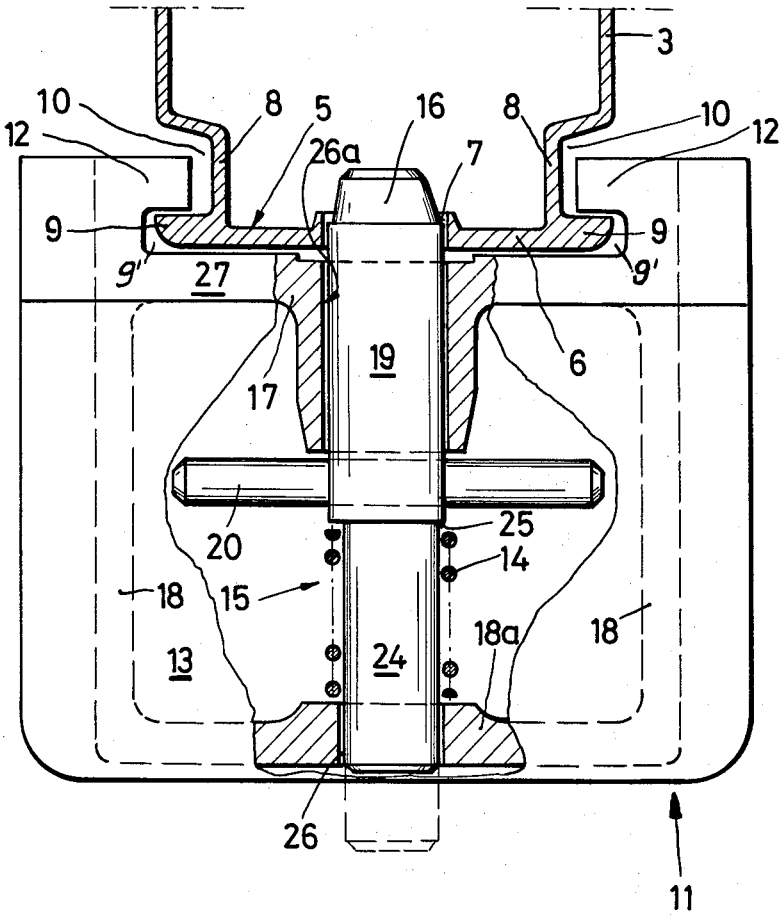
FIG. 2 illustrates a partial horizontal sectional view through an obstacle holding assembly and perpendicularly through the upright post, whereby the obstacle support structure is shown partially broken away to expose the arresting bolt in its hole engaging, arresting position.
Figure 6:
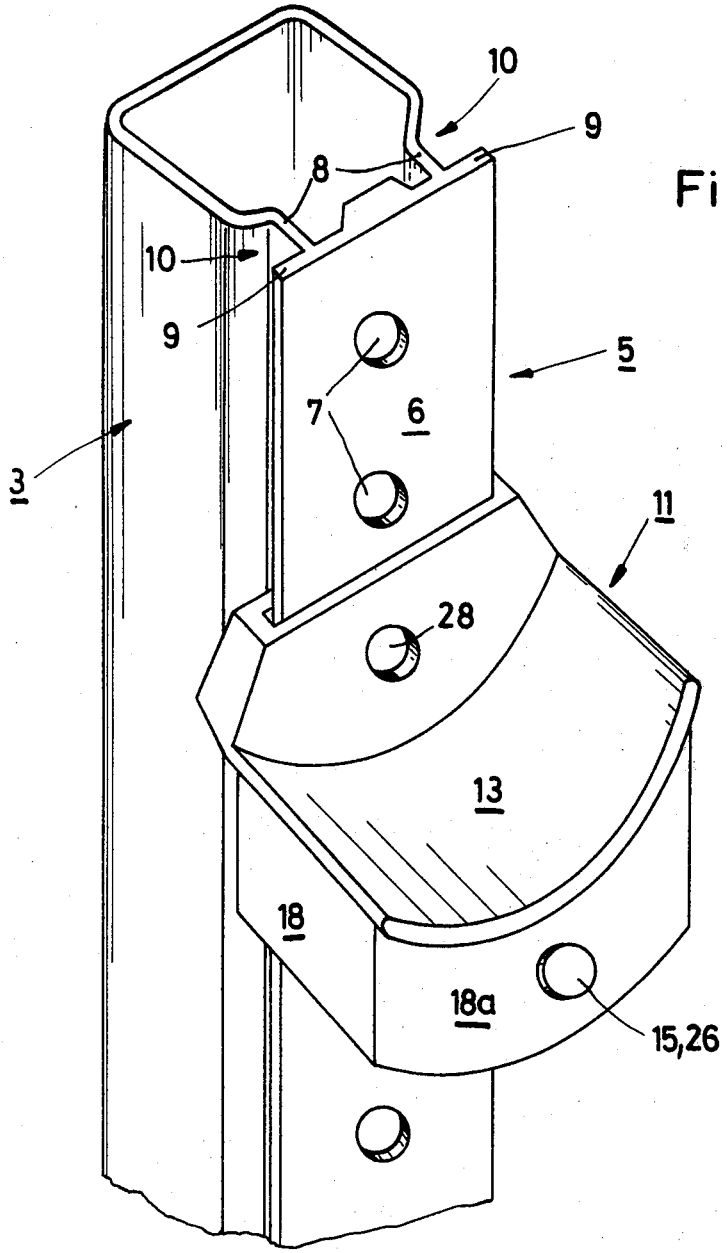
FIG. 6 is a perspective view of an upright post forming an integral structure with the guide rail and of one obstacle holding member for a fence or rail.
Figure 7:
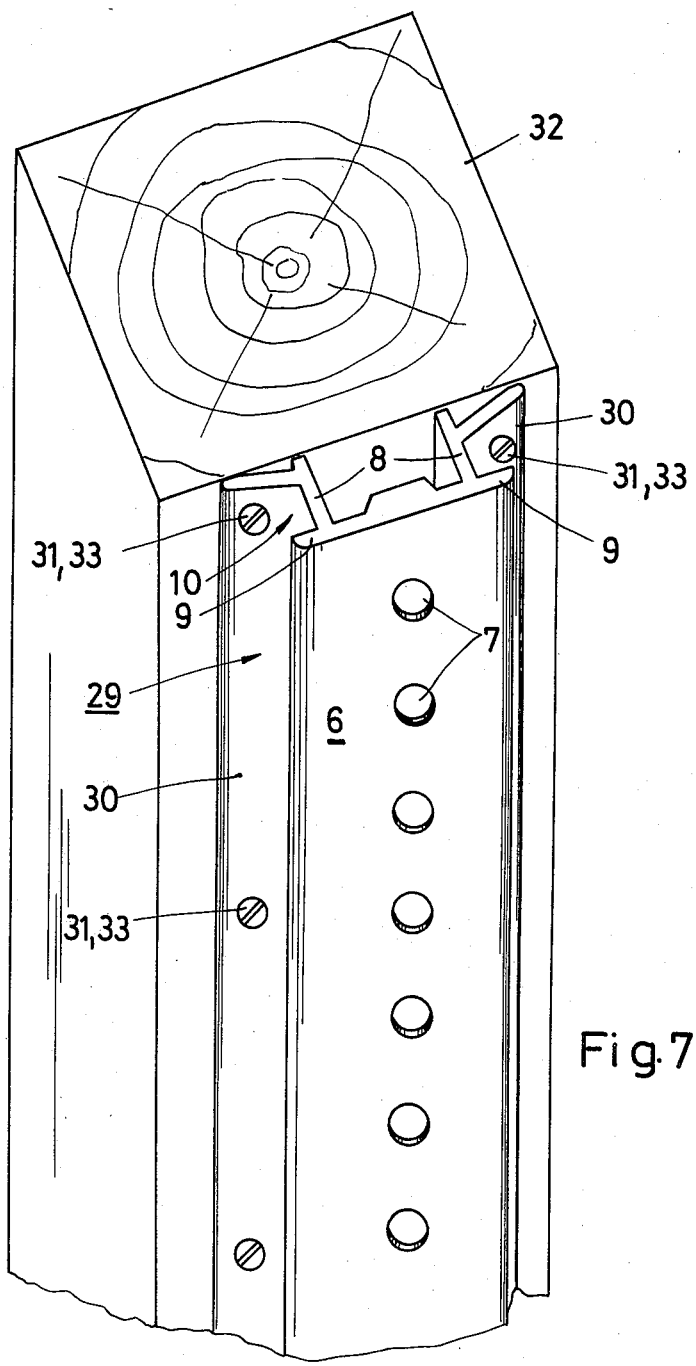
FIG. 7 is a perspective view similar to that of FIG. 6 except that in FIG. 7 the guide rail is a separate component secured to a solid wooden post.

FIG. 2 shows that the upright post 3 and the guide rail 5 may constitute an integral structure of sectional stock. The guide rail 5 provides first guide means including a flat front face member 6 with laterally protruding guide edges 9 and with a row of holes 7 as best seen in FIGS. 6 and 7. The row of holes 7 are preferably arranged symmetrically in alignment with the center axis of the upright post and guide rail. However, off-center hole rows may also be suitable under some circumstances.

Cross members 8 connect the flat front face 6 to the upright posts 3 so that grooves 10 of the first guide means 5 are formed. These grooves 10 extend along the entire length of the guide rail and upright post so that an interlocking engagement is assured between the first guide means of the upright post and second guide means 12 of the obstacle holding structure 11 as best seen in FIG. 2.

The obstacle holding structures 11 are preferably made of a suitable synthetic material and are equipped with so-called half shells 13 facing upwardly for holding the ends of the cross rails 4. The holding means 11 are equipped on their side facing the upright posts with said second guide means in the form of hook type rails 12 which engage into the guide grooves 10 thereby providing the above mentioned interlocking engagement between the first and second guide means, whereby the first and second guide means form mutually interlocking elements so that the obstacle holding means cannot be detached from the upright post means in the horizontal direction.

As best seen in FIGS. 2, 3, 4, and 5, each obstacle holding means or support structure 11 is equipped with an arresting bolt 15 made of wear resistant metal, preferably an aluminum alloy, and having a hole engaging, preferably conical end 16, a larger diameter central portion 19, and a thinner diameter portion 24 so that a shoulder 25 is formed between the larger diameter portion 19 and the end portion 24. A biasing spring 14 is operatively resting with one end against the shoulder 25 and with its other end against a housing wall 18*a* of the obstacle holding means 11. The latter comprises further walls 18 and 17. These walls 17, 18, and 18*a* form a downwardly open recess so that the bolt 15 may be manually operated by means of a pin 20 secured to the bolt 15, preferably by extending the pin 20 through the larger diameter portion 19 at right angles to the longitudinal axis of the bolt 15. Thus, two fingers may be inserted into the recess to press against both ends of the pin 20 for pulling the bolt 15 out of a hole 7 into a withdrawn position shown in dashed lines in FIG. 2. Thus, the outwardly extending dashed position indicates either by visual inspection or by touching that the bolt is withdrawn while the other position of the bolt in which its rear end is flush with the outer surface of the wall 18*a* indicates the hole engaging position of the bolt 15.

Figure 3:
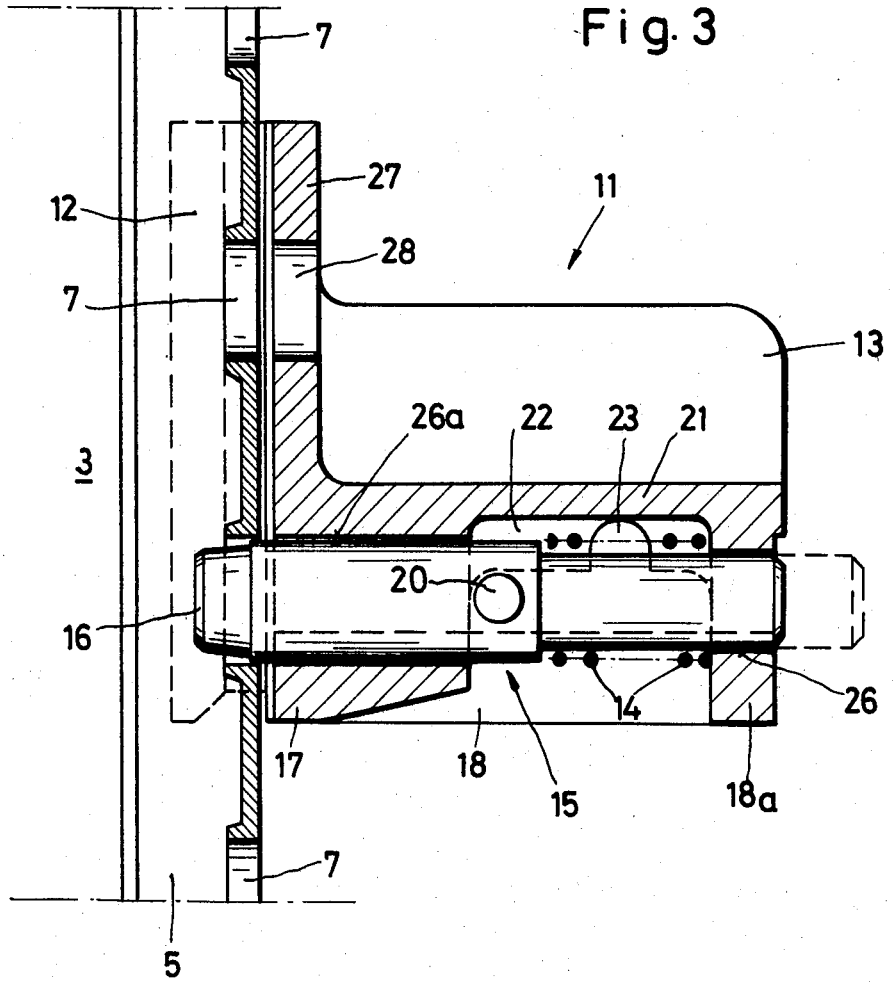
FIG. 3 shows a vertical section through the upright post and through an obstacle support structure, whereby the arresting bolt is again shown in its hole engaging position.

Thus, the bolt 15 is axially movable back and forth in the bores 26 and 26*a* in the housing walls 18*a* and 17 as best seen in FIG. 3. Additionally, the bolt 15 is rotatable about its longitudinal axis by pushing one or the other end of the pin 20 upwardly when the bolt is in the withdrawn, dashed position, whereby one end of the pin 20 may engage into a notch or cut-out 23 in a guide web 22 in the above described housing recess. This arresting of the bolt in the withdrawn position facilitates the adjustment of the holding means 11 along the length of the guide rail 5 and also its initial insertion into the guide groove 10. Two guide webs 22 may be provided in the housing recess to the right and left of the bolt 15 and in parallel thereto so that rotation in either direction will enable the engagement of one end of the pin 20 with one of the notches 23.

FIG. 3 shows particularly that the wall 17 adjacent to the guide rail 5 has an upwardly extending wall element 27 provided with a hole 28. The axial spacing between the bore 26*a* and the hole 28 corresponds exactly to the axial spacing between two adjacent holes 7 in the guide rail 5. Thus, by simply aligning the hole 28 with the appropriate hole 7, it is easy to make sure that the bolt 15 will find its intended hole. Thus, the operator can easily recognize when an arresting position has been reached.

FIG. 6 shows the obstacle holding means 11 in a perspective view, whereby the bolt 15 engages a hole 17 as evidenced by the fact that the visible rear end of the bolt 15 is substantially flush with the outside facing surface of the wall 18*a*. Further, FIG. 6 shows the upwardly open so-called half shell 13 which receives an end of a cross rail 4.

FIG. 7 shows an embodiment in which the guide rail 29 is part of an open faced sectional stock with a front face portion 6 having lateral guide edges 9 forming together with the flanges 31 the above mentioned guide grooves 10, the bottoms of which are formed by the cross members 8 having protruding free ends extending beyond the respective flange 31 for a secure footing on the upright posts 32 which may, for example, be a solid wooden post or the like. Thus, the open side of the sectional rail 29 contacts the post 32 along four lines constituted by the free ends of the cross members 8 and by the free edges of the flanges 31. The flanges 31 are provided with bores to receive fasteners 33 for securing the guide rail 29 to the upright post 32, for example, by means of screws 33 or the like.

Incidentally, the guide webs 22, one of which is shown in FIG. 3, are not illustrated in FIG. 2 for simplicity's sake. However, from the above description it is clear that by pulling the pin 22 backwardly and then rotating the bolt 15, one or the other end of the pin 20 may engage in one or the other notch or cut out 23 for holding the pin when the bolt is held against the force of the biasing spring 14. This biasing spring is so dimensioned that its biasing force will be sufficient to keep the bolt without clattering noise in any one of the holes 7 or to keep one end of the operating pin 20 securely engaged in a notch 23.

The bolt 15 is easily withdrawn from any hole 7 by simply inserting two fingers from below into the downwardly open recess in the housing formed by the walls 18, 18*a*, and 17. When the operating pin 20 is securely locked in one of the notches 23, the entire structure may be easily shifted up and down along the guide rail 3 or 29 and placed on the guide rail initially or it may be removed from the guide rail axially as long as the bolt is held back in a force locking manner under the bias of the spring 14 as described above.

By housing the arresting bolt 15 with its biasing spring 14 in a recess which opens downwardly, the accidental release of the locking bolt 15 is substantially prevented because the operating pin 20 is protected by the so formed housing. Further, by facing the recess downwardly with its opening, the locking mechanism is substantially protected against entry of dirt so that jamming is prevented and maintenance work is reduced.

Incidentally, the rear end position of the bolt 15 as shown in FIG. 2, for example, by full and dashed lines, may also be sensed by touch so that the adjustment is possible even under unfavorable lighting conditions.

The sensing by touch incidentally also applies to the alignment of the hole 28 with a hole 7, whereby again the operator may make an adjustment even under unfavorable lighting conditions.

Referring again to FIG. 2 the interlocking engagement between the hook type edges 12 and the groove 10 as well as between the edges 9 and a respective groove 9' between the wall portion 27 and the hook edges 12, in combination with the flat front face 6 of the guide rail 5 results in a very secure guiding of the holding means all along the guide rails.

A further advantage of the invention is seen in that substantially a standard sectional stock may be employed in manufacturing the present structures in both instances, namely when the guide and the upright post form an integral structure, or when a guide rail of the type shown in FIG. 7 is secured to a separate post.

Making the hole engaging edge 16 of the bolt 15 conical has several advantages. The conical end 16 facilitates finding and entering the hole 7 for a secure arresting function. This conical end portion also assures a uniform, tight fit between the bolt and the hole, thereby preventing a rattling since it compensates for any nonuniform wear or for tolerances in the size of the holes 7.

Further, by making the rear end 24 of the bolt 15 thinner than the intermediate portion 19, the spring 14 may snuggly surround the thinner diameter end 24 of the bolt 15 and is thus kept from interfering with the manipulation of the bolt by means of the operating pin 20.

Although the invention has been described with reference to specific example embodiments, it will be appreciated, that it is intended to cover all modifications and equivalents within the scope of the appended claims.

What is claimed is:

1. A fence support structure, especially for equestrian show jumping, comprising upright post means (3) for supporting horizontal bar means (4) forming an obstacle, obstacle holding means (11) including adjustment means (15, 20) for securing said obstacle holding means to said upright post means, comprising in combination sectional first rail type guide means (5) operatively associated with said upright post means (3) alongside the side thereof facing said obstacle holding means (11), said obstacle holding means including second guide means (12) for slidably engaging said first rail type guide means for sliding up and down said upright post means (3), each of said first and second guide means including interlocking means (9, 10, 12) for holding the obstacle support means against disengagement from the first rail type guide means in a horizontal direction as defined by said bar means (4), said sectional first rail type guide means (5) comprising a row of aligned holes (7), said adjustment means (15, 20) including bolt means (15, 20) movable relative to said adjustment means and fitting into any one of said holes, spring bias means (14) operatively arranged between said bolt means and said obstacle holding means for normally biasing said bolt means to engage into one of said holes, whereby the obstacle holding means are held at an elevation along said upright post means substantially as determined by the engaged hole, and whereby said obstacle holding means are adjustable along said upright post means when said bolt means are withdrawn from said engaged hole, whereby the side of the upright post means facing away from said obstacle holding means remains free of any obstructions.

2. The structure of claim 1, wherein said interlocking means of said sectional rail type first guide means comprise a rail section having a symmetrical sectional configuration relative to a longitudinal center plane with lateral longitudinal grooves (10) in said sectional configuration, said row of holes being aligned relative to said center plane, and wherein said interlocking means of said second guide means of said obstacle holding means comprise a sectional configuration with hook type rails (12) engaging said grooves (10) of said first mentioned sectional configuration so that the obstacle holding means can slide longitudinally along said upright post means when said bolt means are disengaged from any one of said holes so that said obstacle holding means cannot be removed from said upright post means in a direction extending perpendicularly to the longitudinal direction of the upright post means.

3. The structure of claim 1 or 2, wherein said upright post means and said sectional first guide means constitute an integral unit in the form of a hollow section made of light metal.

4. The structure of claim 1 or 2, wherein said upright post means and said sectional first guide means are separate elements, said structure further comprising means operatively interconnecting said separate elements.

5. The structure of claim 4, wherein said sectional first guide means comprise an open sided rail section of light metal having lateral flanges with apertures therein, said interconnecting means comprising fastening means extending through said apertures into said upright post means.

6. The structure of claim 1 or 2, wherein said obstacle holding means comprise a half shell bearing member made of synthetic material.

7. The structure of claim 1 or 2, wherein said bolt means comprise an increased diameter central zone and a reduced diameter zone to form a shoulder between said zones, manual operating means secured to said bolt means for withdrawing said bolt means from engagement with any one of said holes, said adjusting means of said obstacle holding means comprising housing means in which said bolt means are movably received, said housing means including inner notch means located for holding said manual operating means recessed inside said housing means to thereby hold said bolt means in a withdrawn position against the force of said spring bias means located in said housing means and bearing against said shoulder, whereby said operating means are accessible only inside said housing means for preventing an accidental release of said bolt means from a withdrawn position.

8. The structure of claim 7, wherein said housing means for said bolt means comprise wall means forming a downwardly open recess in said housing means, said wall means including wall members having aligned bores in which said bolt means are movably received, said operating means including pin means extending substantially centrally through said bolt means and at a right angle relative to the longitudinal bolt axis, said pin means being received in said downwardly open recess.

9. The structure of claim 8, wherein said housing wall means include a wall element facing said sectional first guide means and extending substantially in parallel to said sectional first guide means, said wall element having a bore therein which is vertically spaced from said aligned, bolt receiving bores to provide a spacing corresponding to the spacing between adjacent holes in said sectional first guide means, whereby the alignment of the bolt means with a hole is facilitated.

10. The structure of claim 1, wherein said sectional first guide means comprise a rail member having a flat facing element in which said holes are arranged in vertical alignment, cross members (8) extending away from said flat facing element so that lateral edges of said flat facing element protrude beyond said cross members, and flange members (30) extending away from said cross members laterally outwardly and spaced from said lateral edges to form a groove between each flange member and the respective lateral edge of the flat facing element so that two guide grooves are formed facing away from each other on opposite sides of said sectional first guide means, said two guide grooves forming said interlocking means of the first guide means for cooperation with said second guide means.

11. The structure of claim 10, wherein said obstacle holding means comprise guide groove means for receiving said lateral edges of said flat facing element, and molding strips alongside said guide groove means for reaching into the respective groove in said rail member.

12. The structure of claim 10, wherein said upright post means and said rail member constitute an integral unit in the form of a hollow section.

13. The structure of claim 1 or 2, wherein said bolt means are made of a suitable metal such as an aluminum alloy.

14. The structure of claim 1 or 2, wherein said bolt means comprise a conical end portion for insertion into any one of said holes.

* * * * *